US011306956B2

(12) United States Patent
Nakayama et al.

(10) Patent No.: US 11,306,956 B2
(45) Date of Patent: Apr. 19, 2022

(54) DOUBLE PIPE ICEMAKER

(71) Applicant: DAIKIN INDUSTRIES, LTD., Osaka (JP)

(72) Inventors: Takahito Nakayama, Osaka (JP); Ryouji Matsue, Osaka (JP); Keisuke Nakatsuka, Osaka (JP); Satoru Ohkura, Osaka (JP); Takeo Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/769,079

(22) PCT Filed: Jan. 11, 2019

(86) PCT No.: PCT/JP2019/000626
§ 371 (c)(1),
(2) Date: Jun. 2, 2020

(87) PCT Pub. No.: WO2019/139109
PCT Pub. Date: Jul. 18, 2019

(65) Prior Publication Data

US 2020/0386461 A1 Dec. 10, 2020

(30) Foreign Application Priority Data

Jan. 15, 2018 (JP) ..... JP2018-004031

(51) Int. Cl.
*F25C 1/12* (2006.01)

(52) U.S. Cl.
CPC ..... *F25C 1/12* (2013.01); *F25C 2301/002* (2013.01)

(58) Field of Classification Search
CPC .. F25C 1/12; F25C 2301/002; F25C 2500/02; F25C 1/145

(Continued)

(56) References Cited

U.S. PATENT DOCUMENTS 1,327,677 A * 1/1920 Kennedy ..... D03D 3/00 156/393
1,641,429 A * 9/1927 Heyman ..... F28D 1/06 62/123

(Continued)

FOREIGN PATENT DOCUMENTS

JP 46-10270 3/1971
JP S4610270 B1 * 3/1971

(Continued)

OTHER PUBLICATIONS

International Preliminary Report of corresponding PCT Application No. PCT/JP2019/000626 dated Jul. 21, 2020.

(Continued)

*Primary Examiner* — Eric S Ruppert
*Assistant Examiner* — Kirstin U Oswald
(74) *Attorney, Agent, or Firm* — Global IP Counselors, LLP

(57) ABSTRACT

A double pipe icemaker includes an inner pipe, and an outer pipe provided radially outside the inner pipe and coaxially with the inner pipe. The outer pipe allows a cooling target to flow in the inner pipe and a refrigerant to flow in a space between the inner and outer pipes. The outer pipe has a wall provided with at least one nozzle to jet the refrigerant into the space. The nozzle has a jet port. The jet port may allow the refrigerant to jet in a radial direction including at least an axial direction and a circumferential direction of the inner pipe. A shielding plate may be provided ahead of the jet port in a jetting direction such that the refrigerant hitting the shielding plate expands along a surface of the shielding plate in a radial direction.

12 Claims, 6 Drawing Sheets

(58) Field of Classification Search
USPC ..... 62/345, 347; 239/132, 128, 132.5, 275, 239/266–269
See application file for complete search history.

(56) References Cited

U.S. PATENT DOCUMENTS 1,975,432 A * 10/1934 Piat ..... F02M 11/08 261/41.3
2,064,597 A * 12/1936 Engelmann ..... A23G 9/163 62/307
2,644,315 A * 7/1953 Holmes ..... F25B 9/04 62/5
2,927,439 A * 3/1960 Polk ..... A23G 9/18 62/66
3,029,615 A * 4/1962 Lindsey ..... F25C 1/145 62/343
3,036,443 A * 5/1962 Trepaud ..... F25C 1/12 62/352
3,053,058 A * 9/1962 Kocher ..... F25C 1/12 62/233
3,091,398 A * 5/1963 Hruby, Jr. ..... B05B 15/74 239/206
3,253,424 A * 5/1966 Van Steenburgh, Jr. ..... F25C 1/12 62/298
3,264,836 A * 8/1966 Miller ..... F25C 1/145 62/115
3,327,494 A * 6/1967 Campbell ..... F25B 39/02 62/352
4,094,168 A * 6/1978 Hamner ..... F25B 39/02 62/347
4,267,699 A * 5/1981 Bahrenburg ..... F16L 55/103 138/89
4,475,688 A * 10/1984 Hodges ..... F25C 3/04 239/102.2
4,551,159 A * 11/1985 Goldstein ..... F25C 1/00 62/541
4,796,441 A * 1/1989 Goldstein ..... F25B 29/003 165/94
5,187,947 A * 2/1993 Breunig ..... A23B 5/041 426/517
5,237,837 A * 8/1993 Naruse ..... F25C 1/12 62/303
5,237,865 A * 8/1993 Wada ..... B08B 9/0322 73/198
6,334,314 B1 * 1/2002 Glazer ..... F17C 13/006 62/51.1
2010/0236272 A1 * 9/2010 Yamamoto ..... F25C 1/145 62/342

FOREIGN PATENT DOCUMENTS

JP 61-86544 A 5/1986
JP 63-162268 U 10/1988
JP 4-10264 U 1/1992
JP 5-118592 A 5/1993
JP 2000-146378 A 5/2000
JP 2000146378 A * 5/2000
JP 2001-153506 A 6/2001
JP 2001153506 A * 6/2001
JP 2006-78137 A 3/2006
KR 10 1433526 B1 8/2014

OTHER PUBLICATIONS

International Search Report of corresponding PCT Application No. PCT/JP2019/000626 dated Apr. 2, 2019.
Supplementary European Search Report of corresponding EP Application No. 19 73 8279.9 dated Feb. 8, 2021.
Office Action of corresponding EP Application No. 19 738 279.9 dated Oct. 28, 2021.

* cited by examiner

DOUBLE PIPE ICEMAKER

CROSS-REFERENCE TO RELATED APPLICATIONS

This U.S. National stage application claims priority under 35 U.S.C. § 119(a) to Japanese Patent Application No. 2018-004031, filed in Japan on Jan. 15, 2018, the entire contents of which are hereby incorporated herein by reference.

BACKGROUND

Field of the Invention

The present disclosure relates to a double pipe icemaker. More specifically, the present disclosure relates to a double pipe icemaker configured to make sherbet ice slurry.

Background Information

Sherbet ice slurry is used to refrigerate fish or the like in some cases. There has been conventionally known, as a device configured to produce such ice slurry, a double pipe icemaker including an inner pipe and an outer pipe (see Japanese Patent No. 3888789 and the like). The double pipe icemaker described in Japanese Patent No. 3888789 includes an inner pipe, and an outer pipe provided radially outside the inner pipe and coaxially with the inner pipe. Cold water or brine as a cooling target flows into the inner pipe via an inlet provided at a first end of the inner pipe, and flows out of an outlet provided at a second end of the inner pipe. A refrigerant used to cool cold water or brine jets into an annular space between the inner pipe and the outer pipe via a plurality of orifices.

SUMMARY

The double pipe icemaker described in Japanese Patent No. 3888789 has a refrigerant jetting direction from the orifices only in a circumferential direction of the inner pipe. The refrigerant jetting out of the orifices thus hits a region in a linear or island shape as part of an outer circumferential surface of the inner pipe, and cools around a rear side of the hit region (an inner circumferential surface of the inner pipe). When the refrigerant hits part of the inner pipe, the refrigerant and the cooling target in the inner pipe fail to uniformly exchange heat, and a heat exchanger including the inner pipe and the outer pipe cannot be utilized effectively.

It is an object of the present disclosure to provide a double pipe icemaker configured to effectively utilize a heat exchanger including an inner pipe and an outer pipe.

A double pipe icemaker according to a first aspect of the present disclosure (1) includes an inner pipe, and an outer pipe provided radially outside the inner pipe and coaxially with the inner pipe, and configured to allow a cooling target to flow in the inner pipe and allow a refrigerant to flow in a space between the inner pipe and the outer pipe, wherein the outer pipe has a wall provided with at least one nozzle configured to jet the refrigerant into the space, and the nozzle has a jet port allowing the refrigerant to jet in a radial direction including at least an axial direction and a circumferential direction of the inner pipe.

The double pipe icemaker according to the first aspect of the present disclosure includes the nozzle configured to jet the refrigerant from the jet port in the radial direction including at least the axial direction and the circumferential direction of the inner pipe, so that the refrigerant is refrained from hitting only a limited region of the inner pipe as in the conventional case. The refrigerant jetted in the radial direction uniformly exchanges heat with the cooling target in the inner pipe, for effective utilization of the heat exchanger including the inner pipe and the outer pipe.

A double pipe icemaker according to a second aspect of the present disclosure (2) includes an inner pipe, and an outer pipe provided radially outside the inner pipe and coaxially with the inner pipe, and configured to allow a cooling target to flow in the inner pipe and allow a refrigerant to flow in a space between the inner pipe and the outer pipe, wherein the outer pipe has a wall provided with at least one nozzle configured to jet the refrigerant radially inward into the space, and a shielding plate hit by the jetting refrigerant is provided ahead of a jet port of the nozzle in a jetting direction.

In the double pipe icemaker according to the second aspect of the present disclosure, the refrigerant jetted radially inward from the jet port of the nozzle hits the shielding plate provided ahead of the jet port in the jetting direction and expands radially along a surface of the shielding plate. The refrigerant expanded in the radial direction uniformly exchanges heat with the cooling target in the inner pipe, for effective utilization of the heat exchanger including the inner pipe and the outer pipe.

(3) In the double pipe icemaker according to (1) or (2), preferably, the inner pipe has a first end provided with an inlet pipe for the cooling target and a second end provided with an outlet pipe for the cooling target, the at least one nozzle includes a plurality of nozzles provided axially along the outer pipe, and the nozzles have jet ports gradually reduced in size from the inlet pipe toward the outlet pipe. In this case, the cooling target immediately after flowing into the inner pipe is higher in temperature than the cooling target adjacent to the outlet pipe. The cooling target immediately after flowing into the inner pipe can be cooled with a larger amount of refrigerant by increase in size of the jet port of the nozzle adjacent to the inlet pipe, for improvement in cooling efficiency of the cooling target.

(4) In the double pipe icemaker according to (1) or (2), preferably, the inner pipe has a first end provided with an inlet pipe for the cooling target and a second end provided with an outlet pipe for the cooling target, the at least one nozzle includes at least three nozzles provided axially along the outer pipe, and the nozzles are disposed at pitches gradually increased in size from the inlet pipe toward the outlet pipe. In this case, the cooling target immediately after flowing into the inner pipe is higher in temperature than the cooling target adjacent to the outlet pipe. The cooling target immediately after flowing into the inner pipe can be cooled with a larger amount of refrigerant by disposing the jet port of the nozzle adjacent to the inlet pipe, for improvement in cooling efficiency of the cooling target.

DETAILED DESCRIPTION OF EMBODIMENT(S)

A double pipe icemaker according to the present disclosure will be described in detail hereinafter with reference to the accompanying drawings. Note that the present disclosure is not limited to the following exemplification, and instead is shown by the scope of claims and includes all changes which are equivalent to the claims in the meanings and within the scope of the claims.

Figure 1:
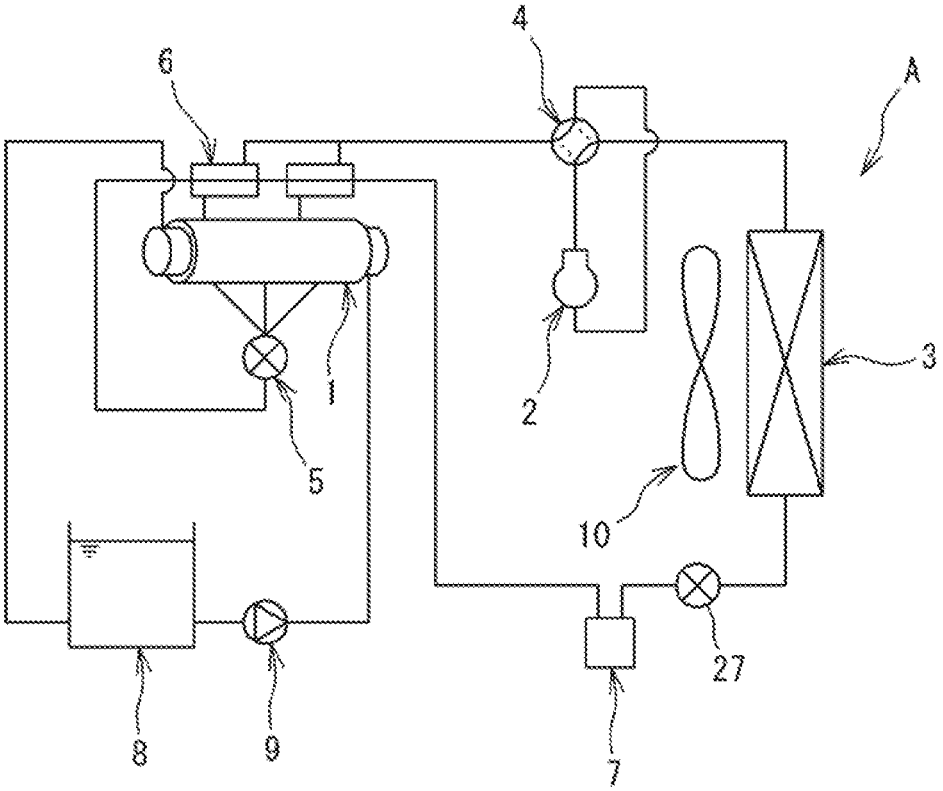
FIG. 1 is a schematic configuration diagram of an ice-making system including a double pipe icemaker according to an embodiment of the present disclosure.

Initially described is an icemaking system including the double pipe icemaker according to the present disclosure. FIG. 1 is a schematic configuration diagram of an icemaking system A including a double pipe icemaker 1 according to an embodiment of the present disclosure.

The icemaking system A adopts seawater as a cooling target, and includes, in addition to the double pipe icemaker 1 constituting a utilization heat exchanger, a compressor 2, a heat source heat exchanger 3, a four-way switching valve 4, an expansion valve 5, a superheater 6, a receiver 7, a seawater tank 8, and a pump 9. The double pipe icemaker 1, the compressor 2, the heat source heat exchanger 3, the four-way switching valve 4, the expansion valve 5, the superheater 6, and the receiver 7 are connected via pipes to constitute a refrigerant circuit. The double pipe icemaker 1, the seawater tank 8, and the pump 9 are similarly connected via pipes to constitute a seawater circuit.

The four-way switching valve 4 is kept in a state indicated by solid lines in FIG. 1 during normal icemaking operation. The compressor 2 discharges a gas refrigerant having high temperature and high pressure, which flows into the heat source heat exchanger 3 functioning as a condenser via the four-way switching valve 4 and exchanges heat with air supplied from a fan 10 to be condensed and liquefied. The liquefied refrigerant flows into the expansion valve 5 via the receiver 7 and the superheater 6. The refrigerant is decompressed to have predetermined low pressure by the expansion valve 5, and is jetted out of a jet port of a nozzle 11 (see FIG. 2) of the double pipe icemaker 1 into an annular space 14 between an inner pipe 12 and an outer pipe 13 constituting the double pipe icemaker 1.

The refrigerant jetted into the annular space 14 exchanges heat with seawater flowing into the inner pipe 12 by means of the pump 9 to be evaporated. The seawater cooled by the evaporated refrigerant flows out of the inner pipe 12 and returns to the seawater tank 8. The refrigerant evaporated and gasified in the double pipe icemaker 1 is sucked into the compressor 2. When the refrigerant still including liquid not evaporated in the double pipe icemaker 1 enters the compressor 2, the refrigerant exits the double pipe icemaker 1 and is superheated by the superheater 6 to return to the compressor 2, in order to protect the compressor 2 that may be damaged with sudden high pressure (liquid compression) or viscosity reduction of ice machine oil. The superheater 6 is of a double pipe type, and the refrigerant exiting the double pipe icemaker 1 is superheated while passing a space between an inner pipe and an outer pipe of the superheater 6 and returns to the compressor 2.

The double pipe icemaker 1 cannot operate if seawater in the inner pipe 12 has a slow flow and ice is accumulated (ice accumulation) in the inner pipe 12 in the double pipe icemaker 1. Defrost operation is executed to melt the ice in the inner pipe 12 in this case. The four-way switching valve 4 is kept in a state indicated by broken lines in FIG. 1 in this case. The compressor 2 discharges a gas refrigerant having high temperature and high pressure, which flows into the annular space 14 between the inner pipe 12 and the outer pipe 13 constituting the double pipe icemaker 1 via the four-way switching valve 4 and the superheater 6, and exchanges heat with seawater containing ice in the inner pipe 12 to be condensed and liquefied. The liquefied refrigerant flows into an expansion valve 27 via the superheater 6 and the receiver 7, is decompressed to have predetermined low pressure by the expansion valve 27, and flows into the heat source heat exchanger 3 functioning as an evaporator. The refrigerant flowed into the heat source heat exchanger 3 functioning as an evaporator during defrost operation exchanges heat with air supplied from the fan 10 to be gasified and sucked into the compressor 2.

Figure 2:
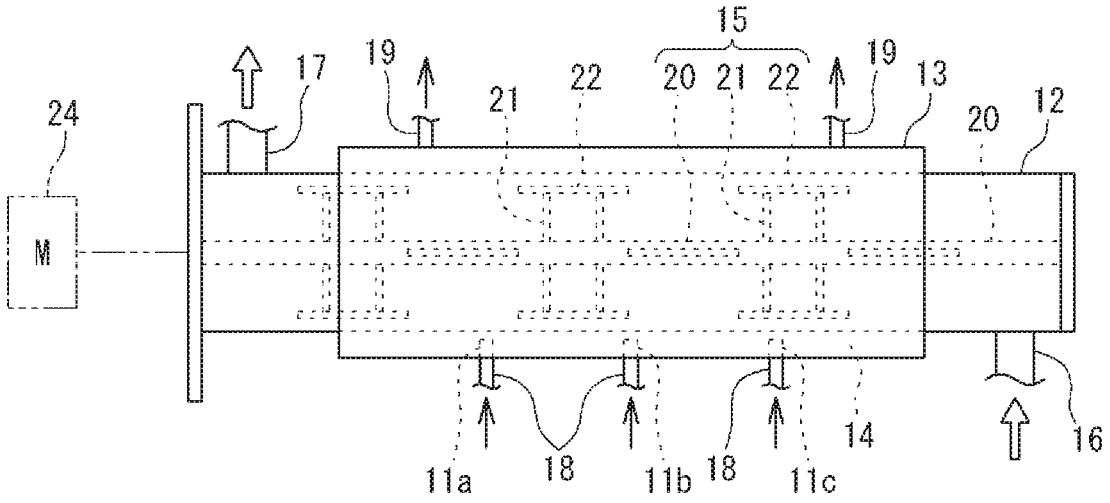
FIG. 2 is an explanatory side view of the double pipe icemaker depicted in FIG. 1.

FIG. 2 is an explanatory side view of the double pipe icemaker 1 according to the embodiment of the present disclosure as depicted in FIG. 1. The double pipe icemaker 1 is of a horizontal type, including the inner pipe 12 and the outer pipe 13.

The inner pipe 12 is an element allowing seawater as a cooling target to pass therethrough, and is made of a metal material such as stainless steel or iron. The inner pipe 12 has closed ends, and is provided therein with a blade mechanism 15 configured to scrape sherbet ice slurry generated on an inner circumferential surface of the inner pipe 12 to disperse the sherbet ice slurry in the inner pipe 12. The inner pipe 12 has a first axial end (a right end in FIG. 2) provided with a seawater inlet pipe 16 allowing seawater to be supplied into the inner pipe 12, and a second axial end (a left end in FIG. 2) provided with a seawater outlet pipe 17 allowing seawater to be drained from the inner pipe 12.

The outer pipe 13 is provided radially outside the inner pipe 12 and coaxially with the inner pipe 12, and is made of a metal material such as stainless steel or iron. The outer pipe 13 has a lower portion provided with a plurality of (three in the present embodiment) refrigerant inlet pipes 18, and an upper portion provided with a plurality of (two in the present embodiment) refrigerant outlet pipes 19. The outer pipe 13 has a wall 13*a* provided with the nozzle 11 configured to jet, into the annular space 14 between the outer pipe 13 and the inner pipe 12, a refrigerant used to cool seawater in the inner pipe 12. The nozzle 11 is provided to communicate with the refrigerant inlet pipes 18.

Figure 3:
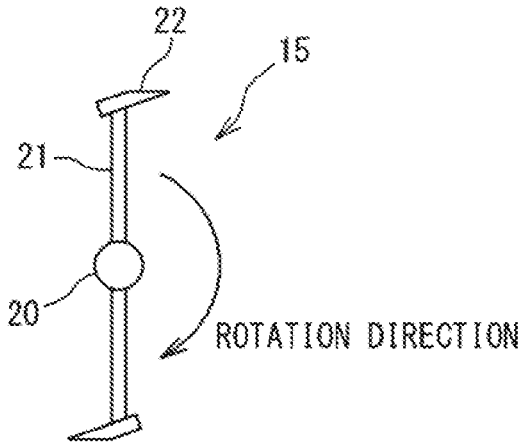
FIG. 3 is an explanatory sectional view of a blade mechanism in the double pipe icemaker depicted in FIG. 2.

As depicted in FIG. 3, the blade mechanism 15 includes a shaft 20, support bars 21, and blades 22. The shaft 20 has a second axial end extending outward from a flange 23 provided at the first axial end of the inner pipe 12, and is connected to a motor 24 constituting a drive unit configured to drive the blade mechanism 15. The shaft 20 has a circumferential surface provided with the support bars 21 disposed at predetermined intervals to stand radially outward, and the blades 22 are respectively attached to distal ends of the support bars 21. The blades 22 may be band plate members made of metal, and each have a tapered lateral edge positioned ahead in a rotation direction.

Figure 4:
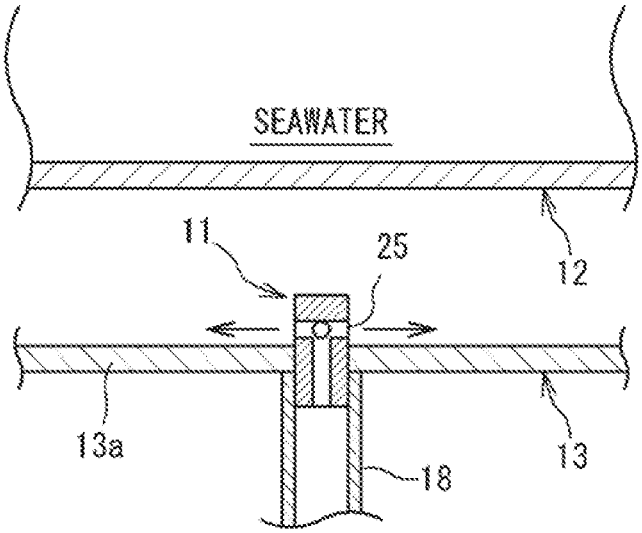
FIG. 4 is an explanatory sectional view of a nozzle included in the double pipe icemaker depicted in FIG. 2.
Figure 5:
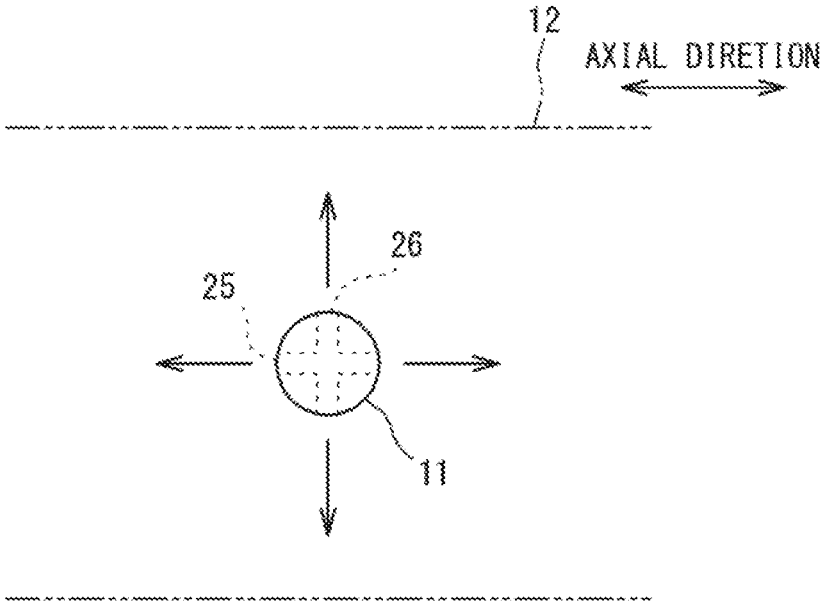
FIG. 5 is an explanatory view of a nozzle jetting direction.

FIG. 4 is an explanatory sectional view of the nozzle 11, and FIG. 5 is an explanatory view of a jetting direction of the nozzle 11. The nozzle 11 according to the present embodiment has a jet port 25 allowing a refrigerant to jet in the axial direction of the inner pipe 12 and a jet port 26 allowing a refrigerant to jet in a circumferential direction of the inner pipe 12. The nozzle 11 according to the present embodiment allows the refrigerant to jet in the axial direction and the circumferential direction of the inner pipe 12 from the jet ports 25 and 26, so that the refrigerant does not hit only a limited region of the inner pipe 12 as in the conventional case. The refrigerant jetted in a radial direction uniformly exchanges heat with seawater in the inner pipe 12, for effective utilization of the heat exchanger (the utilization heat exchanger) including the inner pipe 12 and the outer pipe 13.

The outer pipe 13 according to the present embodiment includes three nozzles 11*a*, 11*b*, and 11*c* provided axially along the outer pipe 13 and having jet ports gradually reduced in size from seawater inlets 18 to seawater outlets 19. Specifically, the jet port of the nozzle 11*b* is smaller in size than the jet port of the nozzle 11*c*, and the jet port of the nozzle 11*a* is smaller in size than the jet port of the nozzle 11*b*. The jet ports of the nozzles 11 are adjusted in size in this manner to allow seawater (higher in temperature than seawater adjacent to the outlet) immediately after flowing into the inner pipe 12 to be cooled with a large amount of refrigerant, for improvement in cooling efficiency of the seawater.

Other Modification Examples

The present disclosure should not be limited to the embodiment described above, but can be modified in various manners within the scope of claims.

The above embodiment exemplifies the nozzle 11 having the jet port allowing the refrigerant to jet in the axial direction and the circumferential direction of the inner pipe 12. The nozzle 11 may further have a jet port allowing the refrigerant to jet in a direction between the axial direction and the circumferential direction. That is, the nozzle 11 can be provided with the jet ports allowing the refrigerant to jet in the radial direction including the axial direction and the circumferential direction of the inner pipe. This configuration achieves more uniform heat exchange between the refrigerant and the cooling target in comparison to the case of providing the jet ports allowing the refrigerant to jet only in the axial direction and the circumferential direction of the inner pipe, for effective utilization of the heat exchanger including the inner pipe and the outer pipe.

Figure 6:
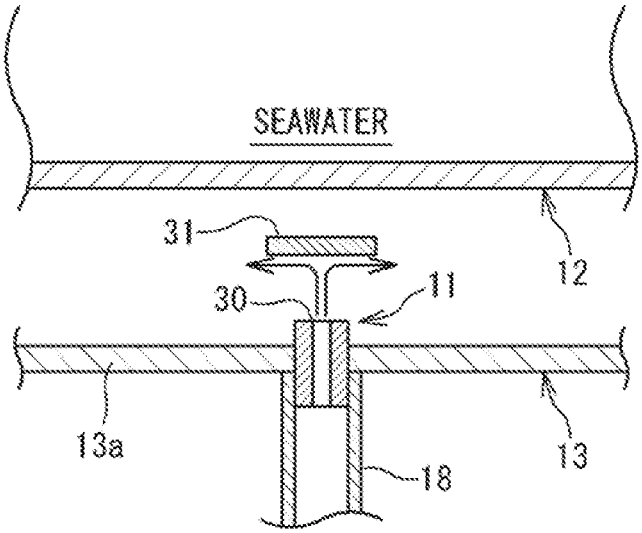
FIG. 6 is an explanatory sectional view of a portion around a nozzle in a double pipe icemaker according to another embodiment of the present disclosure.

The above embodiment provides the nozzle having the radial jetting direction to achieve effective utilization of the heat exchanger. The refrigerant can jet in the radial direction by means of a different measure. As exemplified in FIG. 6, by providing a shielding plate 31 ahead (ahead in the jetting direction) of the jet port 30 of the nozzle 11 provided at the wall 13*a* of the outer pipe 13 and allowing the refrigerant to jet radially inward such that the refrigerant hit the shielding plate 31, the refrigerant can be jetted in the radial direction. The refrigerant having hit the shielding plate 31 expands radially along a surface of the shielding plate 31. The refrigerant will not hit only the limited region of the inner pipe 12 as in the conventional case. The refrigerant expanded in the radial direction uniformly exchanges heat with seawater in the inner pipe 12, for effective utilization of the heat exchanger (the utilization heat exchanger) including the inner pipe 12 and the outer pipe 13.

The above embodiment provides the nozzles 11 having the jet ports gradually reduced in size from the seawater inlet pipe 16 toward the seawater outlet pipe 17. The nozzles may alternatively be disposed at pitches gradually increased from the seawater inlet pipe 16 toward the seawater outlet pipe 17. Specifically, among the three nozzles 11 according to the embodiment as depicted in FIG. 2, the nozzle 11*b* and the nozzle 11*a* can have a larger pitch than the pitch between the nozzle 11*c* and the nozzle 11*b*. This configuration allows seawater (higher in temperature than seawater adjacent to the outlet) immediately after flowing into the inner pipe 12 to be cooled with a large amount of refrigerant, for improvement in cooling efficiency of the seawater.

The above embodiment provides the three nozzles. There may alternatively be provided at most two nozzles, or at least four nozzles, in accordance with length of the inner pipe.

The above description refers to the single double pipe icemaker provided in the icemaking system. The icemaking system may alternatively include two or more double pipe icemakers disposed in series or parallelly.

The above description exemplifies the double pipe icemaker of a horizontal type. The present disclosure is also applicable to a double pipe icemaker of a vertical type

What is claimed is:

1. A double pipe icemaker comprising:

an inner pipe; and an outer pipe provided radially outside the inner pipe and coaxially with the inner pipe, the outer pipe being configured to allow a cooling target to flow in the inner pipe and allow a refrigerant to flow in a space between the inner pipe and the outer pipe;

a plurality of nozzles provided in a wall of the outer pipe, each of the plurality of nozzles being configured to jet the refrigerant into the space; and a plurality of refrigerant inlet pipes, each of the plurality of refrigerant inlet pipes being connected to a respective one of the nozzles, each of the nozzles and each of the refrigerant inlet pipes being separate pieces attached together, and each of the nozzles having at least one jet port formed in an outer circumference thereof such that the refrigerant jets in at least one radial direction of the nozzle, the inner pipe having a first end provided with an inlet pipe for the cooling target, and a second end provided with an outlet pipe for the cooling target, the first end and the second end being spaced apart in an axial direction of the inlet pipe and the outlet pipe, the plurality of nozzles being arranged axially along the outer pipe, and a size of the at least one jet port of each of the nozzles being different from a size of the at least one jet port of others of the nozzles such that the jet ports decrease in size from an inlet pipe side of the outer pipe toward an outlet pipe side of the outer pipe, the inlet pipe side and the outlet pipe side of the outer pipe corresponding to the first end and the second end, respectively, of the inner pipe.

2. The double pipe icemaker according to claim 1, wherein the at least one radial direction is oriented in at least one of an axial direction and a circumferential direction of the inner pipe.

3. The double pipe icemaker according to claim 2, wherein the at least one jet port comprises four jet ports and the at least one radial direction comprises four radial directions, of which two are oriented along the axial direction of the inner pipe and two are oriented along the circumferential direction of the inner pipe.

4. The double pipe icemaker according to claim 1, wherein each of the plurality of nozzles passes through the wall of the outer pipe and connects to the respective one of the refrigerant inlet pipes.

5. The double pipe icemaker according to claim 1, wherein each of the plurality of nozzles fits into an inner circumference of the respective one of the refrigerant inlet pipes.

6. The double pipe icemaker according to claim 1, wherein a distal end face of each of the plurality of nozzles is closed.

7. A double pipe icemaker comprising:

an inner pipe; and an outer pipe provided radially outside the inner pipe and coaxially with the inner pipe, the outer pipe being configured to allow a cooling target to flow in the inner pipe and allow a refrigerant to flow in a space between the inner pipe and the outer pipe;

at least one nozzle provided in a wall of the outer pipe, the at least one nozzle having a jet port formed in distal end face thereof to jet the refrigerant into the space along a radial direction of the inner pipe;

at least one refrigerant inlet pipe connected to the at least one nozzle; and at least one plate shaped shielding plate that is discrete from the at least one nozzle and arranged to be hit by the jetting refrigerant, the at least one shielding plate being provided in the space radially inward of the jet port and having a surface that is closed at a position opposing the jet port in the radial direction of the inner pipe, the surface being parallel to an axial direction of the inner pipe such that the refrigerant hits the at least one shielding plate and expands along the surface in at least one radial direction of the nozzle.

8. The double pipe icemaker according to claim 7, wherein the at least one nozzle comprises a plurality of nozzles, the at least one refrigerant inlet pipe comprises a plurality of refrigerant inlet pipes, each of the refrigerant inlet pipes being connected to a respective one of the nozzles, and the at least one shielding plate comprises a plurality of shielding plates, each of the shielding plates being provided opposing the jet port of a respective one of the nozzles.

9. The double pipe icemaker according to claim 7, wherein the at least one nozzle comprises a plurality of nozzles, and the at least one refrigerant inlet pipe comprises a plurality of refrigerant inlet pipes, each of the refrigerant inlet pipes being connected to a respective one of the nozzles, the inner pipe having a first end provided with an inlet pipe for the cooling target, and a second end provided with an outlet pipe for the cooling target, the first end and the second end being spaced apart in the axial direction, the plurality of nozzles being arranged axially along the outer pipe, and a size of the jet port of each of the nozzles being different from a size of the jet port of others of the nozzles such that the jet ports decrease in size from an inlet pipe side of the outer pipe toward an outlet pipe side of the outer pipe, the inlet pipe side and the outlet pipe side of the outer pipe corresponding to the first end and the second end, respectively, of the inner pipe.

10. The double pipe icemaker according to claim 7, wherein the at least one nozzle comprises a plurality of nozzles, and the at least one refrigerant inlet pipe comprises a plurality of refrigerant inlet pipes, each of the refrigerant inlet pipes being connected to a respective one of the nozzles, the inner pipe having a first end provided with an inlet pipe for the cooling target and a second end provided with an outlet pipe for the cooling target, the first end and the second end being spaced apart in the axial direction, the plurality of nozzles including at least three nozzles arranged axially along the outer pipe, and the nozzles being disposed at pitches gradually increased in size from an inlet pipe side of the outer pipe toward an outlet pipe side of the outer pipe, the inlet pipe side and the outlet pipe side of the outer pipe corresponding to the first end and the second end, respectively, of the inner pipe.

11. The double pipe icemaker according to claim 7, wherein the at least one nozzle passes through the wall of the outer pipe and connects to the at least one refrigerant input pipe.

12. A double pine icemaker comprising:

an inner pipe; and an outer pipe provided radially outside the inner pipe and coaxially with the inner pine, the outer pipe being configured to allow a cooling target to flow in the inner pipe and allow a refrigerant to flow in a space between the inner pine and the outer pipe;

a plurality of nozzles provided in a wall of the outer pipe, each of the plurality of nozzles being configured to jet the refrigerant into the space; and a plurality of refrigerant inlet pipes, each of the plurality of refrigerant inlet pipes being connected to a respective one of the nozzles, each of the nozzles and each of the refrigerant inlet pipes being separate pieces attached together, and each of the nozzles having at least one jet port formed in an outer circumference thereof such that the refrigerant jets in at least one radial direction of the nozzle, the inner pipe having a first end provided with an inlet pipe for the cooling target and a second end provided with an outlet pipe for the cooling target, the first end and the second end being spaced apart in an axial direction of the inlet pipe and the outlet pipe, the plurality of nozzles including at least three nozzles arranged axially along the outer pipe, and the nozzles being disposed at pitches gradually increased in size from an inlet pipe side of the outer pipe toward an outlet pipe side of the outer pipe, the inlet pipe side and the outlet pipe side of the outer pipe corresponding to the first end and the second end, respectively, of the inner pine.

* * * * *